US005458424A

United States Patent [19]

Kato et al.

[11] Patent Number: 5,458,424

[45] Date of Patent: Oct. 17, 1995

[54] SERIAL DOT PRINTER DEVICE

[75] Inventors: Yukihisa Kato, Higashimurayama; Hidehiro Takano, Tokorozawa, both of Japan

[73] Assignee: Citizen Watch Co., Ltd., Tokyo, Japan

[21] Appl. No.: 127,550

[22] Filed: Sep. 28, 1993

[30] Foreign Application Priority Data

Sep. 30, 1992 [JP] Japan ..... 4-283501

[51] Int. Cl.[6] ..... B41J 2/375; B41J 19/30

[52] U.S. Cl. ..... 400/279; 400/323

[58] Field of Search ..... 400/323, 124.03, 400/279, 320, 120.14

[56] References Cited

U.S. PATENT DOCUMENTS

| | | | |
|---|---|---|---|
| 4,540,295 | 9/1985 | Okunishi et al. | 400/124.03 |
| 4,653,940 | 3/1987 | Katsukawa | 400/124.03 |
| 5,152,619 | 10/1992 | Niikawa et al. | 400/124.03 |

FOREIGN PATENT DOCUMENTS

| | | | |
|---|---|---|---|
| 1-56916 | 12/1989 | Japan | 400/323 |
| 215545 | 8/1990 | Japan | 400/323 |
| 243361 | 9/1990 | Japan | 400/124.03 |

*Primary Examiner*—Ren Yan
*Assistant Examiner*—Steven S. Kelley
*Attorney, Agent, or Firm*—Lowe, Price, LeBlanc & Becker

[57] ABSTRACT

A serial printer for preventing the coil of a print head from being burned, by detecting the temperature of the print head to switch the printing mode of the print mode from a bidirectional mode to a split mode in accordance with the detected temperature. This serial printer comprises: a print head bidirectionally movable for printing line by line according to print data; temperature detecting means for detecting the temperature of the print head; print data density discriminating means for discriminating whether the print data of one line of the print data inputted have high density or low density; and print control means for switching the printing mode of the print head from a bidirectional printing mode to a split mode, in which one line is printed separately by at least two times, when it is determined that the print data of the one line is of high density and that the detected value of the temperature detecting means exceeds a predetermined value. The coil of the print head is prevented from being burned, without using any thermal conducting agent, so that a sufficiently high effective printing speed can be achieved.

4 Claims, 7 Drawing Sheets

SERIAL DOT PRINTER DEVICE

BACKGROUND OF THE INVENTION

1. Field of the Invention

The present invention relates to a serial printer device in which the coil of a print head is prevented from being burned by detecting the temperature of the print head switching the printing mode of the print head in accordance with the detected temperature.

2. Description of the Relevant Art

There is known from Japanese Patent Publication No. 1-56916 (published on Dec. 1, 1989) a serial printer which includes: a temperature detecting element disposed in or around a print head for detecting the temperature of the print head; and control means for switching a bidirectional printing mode to a unidirectional print mode when the detected temperature detected by the temperature detecting element exceeds a predetermined value. In case the bidirectional printing operation is carried out at a high speed, the print head has its temperature raised gradually. In the aforementioned serial printer, the coil of the print head is prevented from being burned even if the temperature of the print head rises, by switching the bidirectional print mode to the unidirectional printing mode.

In general, when a high-density printing operation, in which the frequency of actions of the armature of the print head per one line is high (for example, a printing to paint out one line) is repeated, the temperature of the coil in the print head rises. As a matter of fact, the temperature rising rate of the coil is so high that the temperature detecting element in the print head cannot follow the rise, to cause a considerable difference between the temperature of the coil and the detected temperature of the temperature detecting element. In the prior art, therefore, the temperature to be set for switching the bidirectional printing mode to the print stopping mode or the unidirectional printing mode when the coil temperature rises is set to a far lower level than the temperature at which the coil is actually burned. Specifically, the set value to be compared with the detected value of the temperature detecting element is set to a far lower level than the limit temperature, below which the coil is not burned, so that the printing mode is switched to the print stopping mode or the unidirectional printing mode when the detected value of the temperature detecting element reaches said set value. The aforementioned set value to be compared with the detected value of the temperature detecting element is so set to the limit temperature, below which the coil is not burned when in the high-density printing operation of high heat generation of the coil that the coil may not be burned during the various printing operations of the printer. In the actual printing operation, the printing density per line may be high or low. In case of repeating the low-density printing operation, the temperature rising rate of the coil is gentle and therefore the difference between the detected value of the temperature detecting element and the actual coil temperature is small. In such case, the detected value of the temperature detecting element may reach the set value although the actual coil temperature is far from the coil unburned limit temperature. As a result, the switching control to the print stopping mode or the unidirectional print mode is effected to cause a problem that the throughput time, i.e., the time period for printing a predetermined amount is elongated.

In order to solve this problem, it is sufficient to enhance the response of the temperature detecting element, i.e., to reduce the difference between the coil temperature and the temperature detected by the temperature detecting element. For this, there can be conceived a method of filling a thermal conducting agent or the like between the temperature detecting element and the coil. However, this method leads to another problem that the production cost is raised.

In general, moreover, the carriage speed for the unidirectional printing operation is set to be higher in the non-printing return than in the printing operation. This of carriage speed becomes larger in the high-density printing mode, and therefore the time period for cooling the coil of the print head is so short that little effect is obtained for suppressing the rise of the coil temperature.

SUMMARY OF THE INVENTION

An object of the present invention is to provide a serial dot printer device capable of preventing the coil of a print head from being burned in the printing operation and suppressing the reduction of the effective printing speed without using any thermal conducting agent.

According to an aspect of the present invention, there is provided a serial dot printer device comprising: a print head bidirectionally movable for printing line by line according to print data; temperature detecting means disposed in the vicinity of said print head for detecting the temperature of said print head; print data density discriminating means for discriminating whether the print data of one line of the print data inputted have high density or low density; and print control means for switching the printing mode of said print head from a bidirectional printing mode to a split mode, in which one line is printed separately by at least two times, when it is determined by said print data density discriminating means that the print data of the one line are of high density and that the detected value of said temperature detecting means exceeds a predetermined value.

According to another aspect of the present invention, there is provided a serial dot printer device comprising: a print head bidirectionally movable for printing line by line according to print data; temperature detecting means disposed in the vicinity of said print head for detecting the temperature of said print head; print data density discriminating means for discriminating whether the print data of one line of the print data inputted have high density or low density; comparing means for comparing the detected value of said temperature detecting means with a predetermined value; and print control means for switching the printing operation of said print head on the basis of the discrimination result of said print data density discriminating means and the comparison result of said comparing means, wherein said comparing means compares the detected temperature with a first set value, when it is discrimination by said print data density discriminating means that the print data of one line are of low density, and said detected temperature with a second set value when it is determined by said print data density discriminating means that the print data of one line are of high density, and wherein said first set value is higher than said second set value.

DETAILED DESCRIPTION OF THE PREFERRED EMBODIMENT

Figure 1:
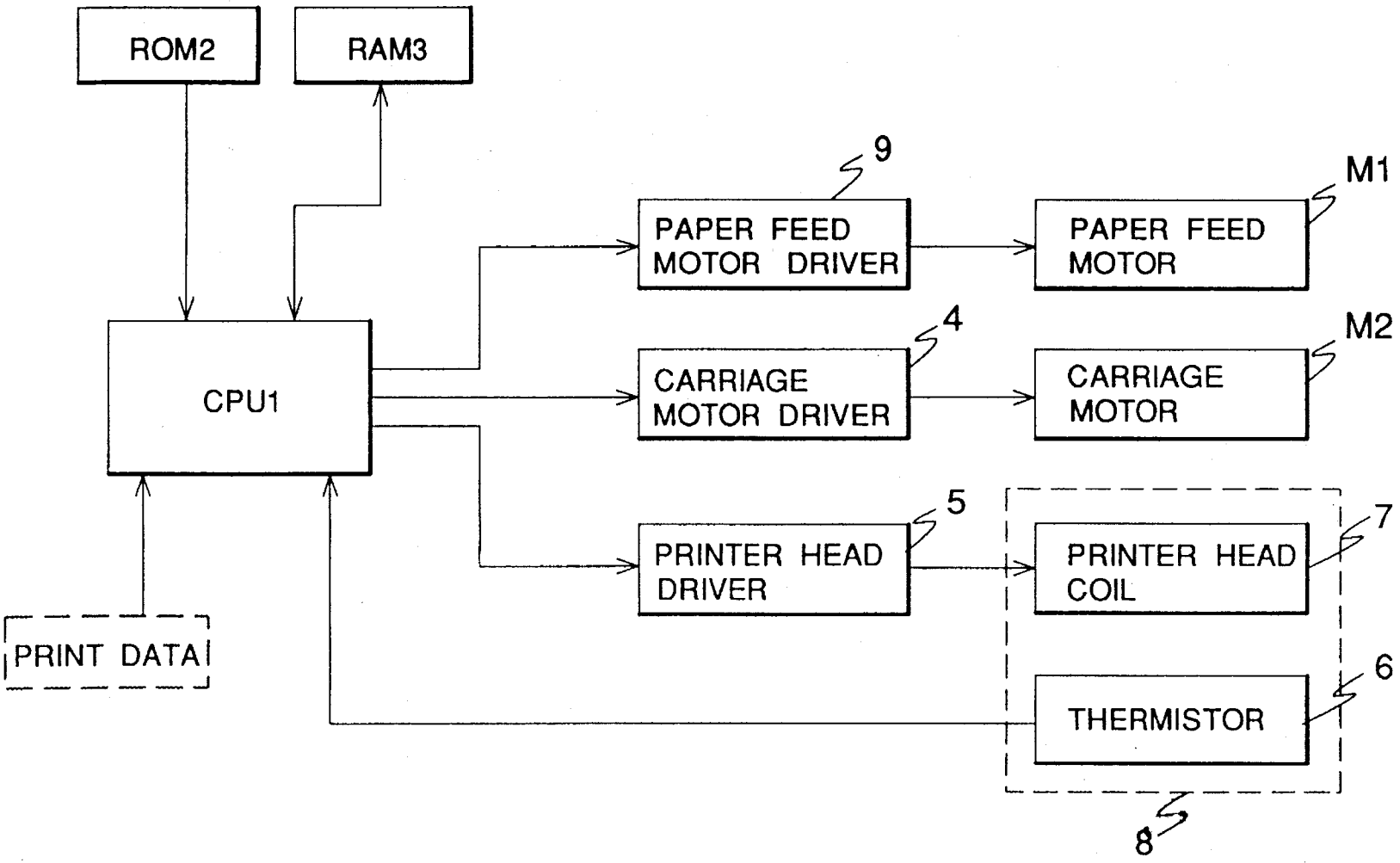
FIG. 1 is a block diagram showing an essential portion of a serial dot printer device according to an embodiment of the present invention.

A serial dot printer device of the present embodiment includes, as shown in FIG. 1, a ROM 2 stored with control programs of individual portions and various setting data for printing controls, a RAM 3 used for temporary storage of data, and a CPU 1 for controlling drives of the individual portions in accordance with the control programs of the ROM 2. The CPU 1 also acts as temperature condition determining means and print data density discriminating means.

With this CPU 1, there are connected: through a paper feed motor drive circuit 9 a paper feed motor M1 for feeding paper; through a carriage motor driver 4 a carriage motor M2 for moving a carriage carrying a print head 8 bidirectionally; and through a print head driver 5 a print head coil 7 for actuating the print head 8 in the printing operation. Further connected with the CPU 1 is a temperature detecting element which is composed of a thermistor 6 for detecting the temperature of the print head coil 7.

Figure 2:
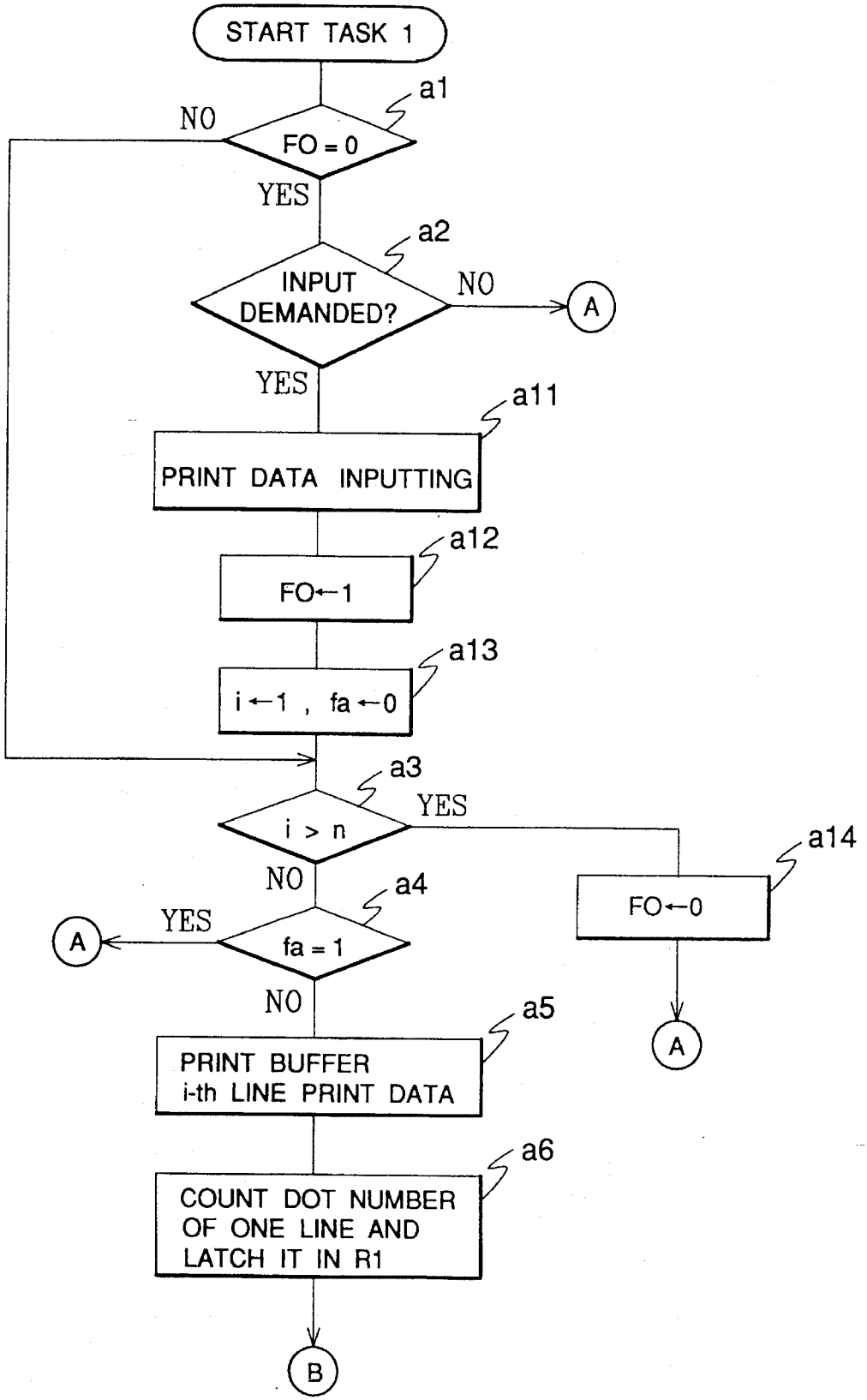
FIG. 2 is a flow chart showing a portion of the processing to be executed by the CPU of the serial dot printer device shown in FIG. 1.
Figure 3:
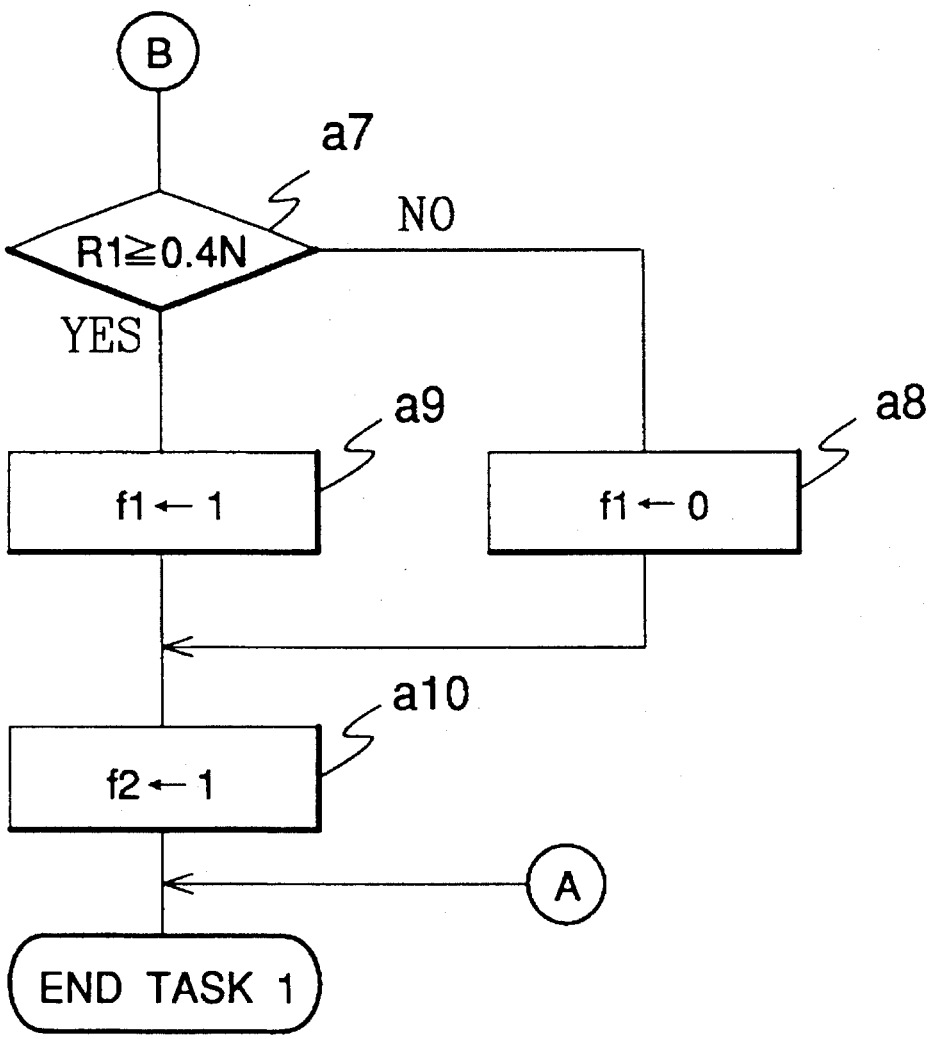
FIG. 3 is a continuation of the flow chart of FIG. 2.
Figure 4:
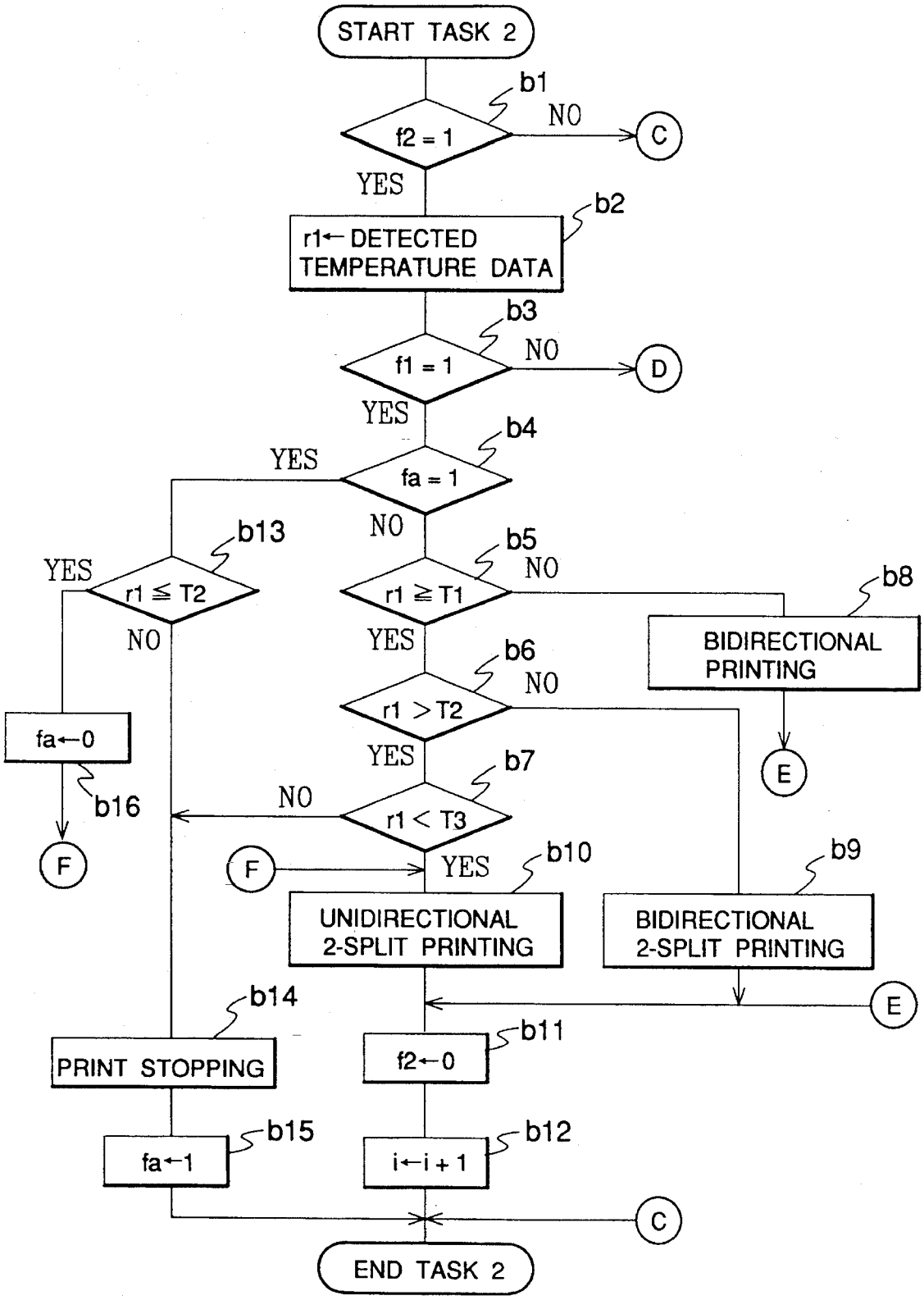
FIG. 4 is a flow chart showing a portion of a one-line printing processing to be executed by the CPU of the serial dot printer device shown in FIG. 1.
Figure 5:
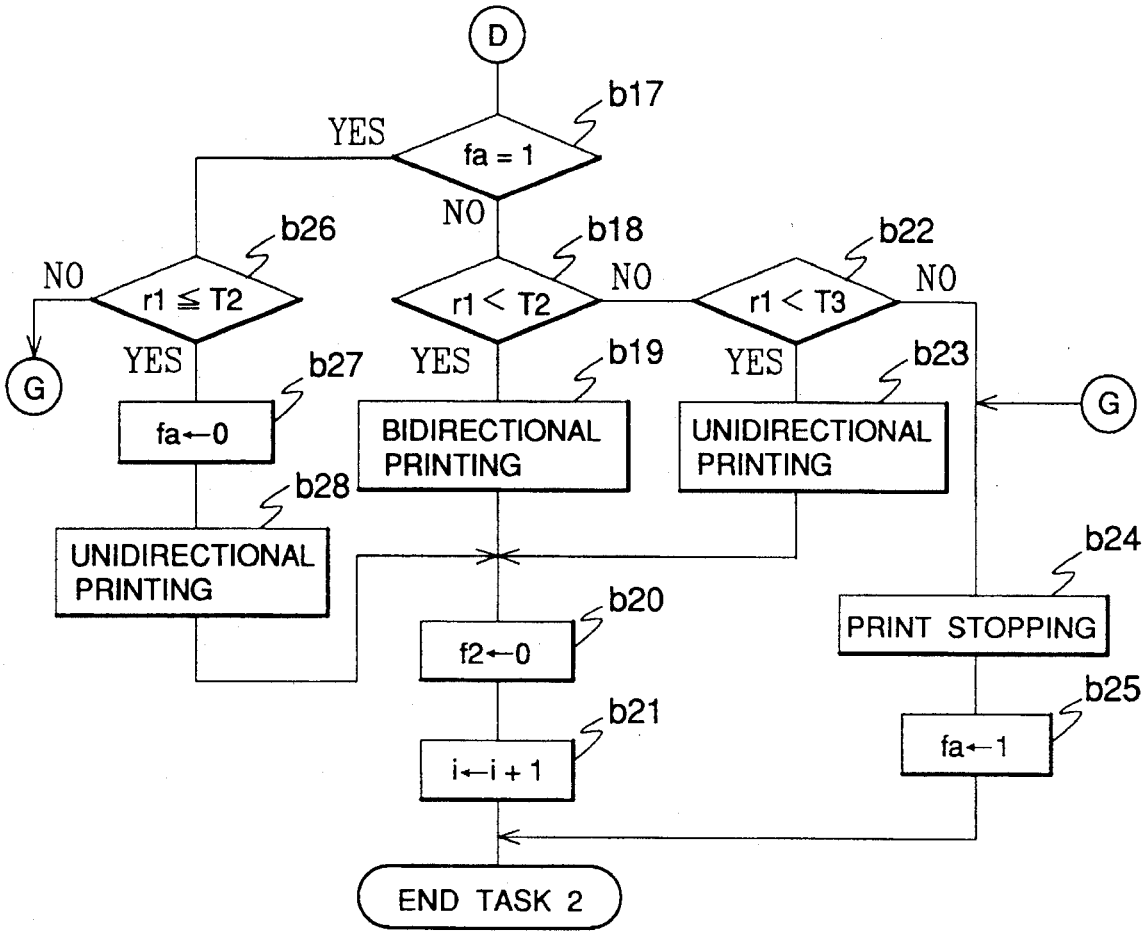
FIG. 5 is a continuation of the flow chart of FIG. 4.

With reference to FIGS. 2 to 5, here will be described the print controlling processing executed by the CPU 1 in accordance with the control program stored in the ROM 2. Incidentally, the processing of Task 1, as shown in FIGS. 2 and 3, and the processing of Task 2, as shown in FIGS. 4 and 5, are executed repeatedly in parallel for every processing periods of an order of μs.

The processing of Task 1 includes the processing for inputting print data, the processing of print data for printing every one line, and the processing of discriminating the printing density of print data of one line.

In case the CPU 1 is demanded for the printing operation by a not-shown host CPU connected with the printer, it determines whether or not the print data can be inputted. Specifically, it is determined at Step a1 whether or not a print data input flag F0 has a value "0" specifying an input wait. Only if the print data input flag F0 is at the value "0", the processing proceeds to Step a2, at which it is determined whether or not the demand for inputting the print data from the host CPU. When the demand for inputting the print data from the host CPU is detected, the CPU 1 proceeds to Step a11, at which the processing of inputting a necessary amount of print data is executed. After the processing of Step a11, the print data input flag F0 is set to "1" at Step a12, at which the start of print control processing is stored. At subsequent Step a13, an index register i indicating the line number of the one-line print and a flag indicating the print stop processing are initialized, and the processing proceeds to Step a3.

By executing the processing of Step a11, the print data sent from the host side are stored in the print data storage area of the RAM 3.

If it is determined at Step a2 that the demand for inputting print data from the host CPU is not detected, the CPU 1 ends the processing of Task 1. In this case, no substantial printing operation is executed. If it is determined at Step a1 that the print data input flag F0 is false, i.e., other than "0", this means that the print data have already been inputted from the host side. Thus, the processing proceeds to Step a3, at which the CPU 1 executes the processing after the inputting of the print data.

At Step a3, the CPU 1 determines whether or not the present value of the index register i exceeds the final value n indicating the end of the print data. The index register i has its value updated by one in the later-described processing of Task 2 each time the CPU 1 ends the printing of one-line print data. Moreover, the initial value of the index register i is set to "1" by the operation of Step a13. Immediately after the start of the printing operation, the value of the index register i is at the initial value "1". As a result, the determination result of Step a3 is false so that the CPU 1 proceeds to Step a4.

Subsequently, the CPU 1 determines whether or not a print stop flag fa has a value specifying the print stop state. This print stop flag fa is set to the value "1", when it is detected in the later-described processing of Task 2 that the detected temperature of the print head coil 7 has reached, as the printing operation is continued, such a predetermined value as is set not to burn the coil. The following description will be made assuming that the print head coil 7 has a low temperature immediately after the start of the printing operation. Moreover, the print stop flag fa is set to the initial value "0" in the operation of Step a13 after the inputting of print data.

In this case, the print stop state is not caused at present, and the determination in Step a4 results to be false so that the CPU 1 proceeds to Step a5. At Step a5, the CPU 1 reads the one-line print data out of the print data area, which is stored in the RAM 3, on the basis of the present value of the index register i and latches them in a print buffer to be used exclusively for the printing operation. At subsequent Step a6, the total number of dots required for printing one line of the one-line print data latched in the print buffer is counted, and the result of counting is stored in a dot number storage register R1.

After the operation of Step a6, the CPU 1 determines (at Step a7) whether or not the value of dot number necessary for the one-line printing of the one-line print data stored in the dot number storage register R1 has reached a predetermined ratio, e.g., 0.4 to the total dot number N of one line, that is, the dot number necessary for smearing up the one line. If the determination result of Step a7 is true, the density is determined to be high, and a printing density flag f1 is set (at Step a9) to the value for specifying the high density. If the determination result is false, on the other hand, the density is determined to be low, and the printing density flag f1 is set (at Step a8) to the value "0" specifying the low density. After the processing of Step a8 or Step a9, the CPU 1 proceeds to Step a10, at which a one-line print flag f2 is set to "1" to allow execution of the one-line printing, and the processing of Task 1 is ended.

In case the one-line print data are wholly composed of letter data, the density is determined to be low. In case the one-line print data are wholly composed of graphic data, the density is determined to be high.

If it is determined at Step a4 that the value of the aforementioned print stop flag fa is the value "1" specifying the print stop state, the CPU 1 ends the processing of Task 1 without executing the processing at and after Step a5.

In case the one-line print flag f2 is set to "1" to allow execution of the one-line printing, the print data input flag F0 is set to the value "1" in the processing of Task 1 on and after the subsequent period. As a result, the determination result of Step a1 is false, and the processing proceeds to Step a3. If the present value of the index register i fails to exceed the value "n" specifying the last of the print data, the determination result of Step a3 is false, and the processing proceeds to Step a4. If the determination result of Step a4 is false, the processing proceeds to Step a5. In case the one-line printing is ended in the processing of Task 2, the value of the index register i is updated in the operation of Step a5 so that the next one-line print data are prepared.

The processing of Task 2 is directed to execute the one-line printing, and the CPU 1 executes determination of the value of the print density flag f1, only in case the one-line print flag f2 is set to "1" by the processing of Task 1. In accordance with this determination result, the CPU 1 compares the detected temperature data of the thermistor 6 to execute the controls of high density printing and the low density printing.

When the processing of Task 2 is started, the CPU 1 determines at first Step b1 whether or not the one-line print flag f2 takes the value "1" specifying allowance of execution of the one-line printing. If the determination result of Step b1 is that the value of one-line print flag f2 is not "1", the CPU 1 ends the processing of Task 2. In this case, the one-line printing operation of Task 2 is not substantially executed.

If the one-line print flag f2 takes the value "1" specifying execution of the one-line printing, the CPU 1 proceeds to Step b2. At Step b2, detected temperature data corresponding to the detected temperature of the thermistor 6 disposed in the print head 8 are read and stored in a detected temperature storage register r1. At subsequent Step b3, it is discriminated from the value of the printing density flag f1 which the density of the one-line printing to be executed at this time is high or low. Specifically, the CPU 1 determines whether or not the printing density flag f1 is set to the value "1" specifying the high density. If the determination result is true, the processing proceeds to Step b4, at which the one-line printing operation of the high density is executed. If the determination result is false, the processing proceeds to Step b17, at which the one-line printing operation of the low density is executed.

Figure 6:
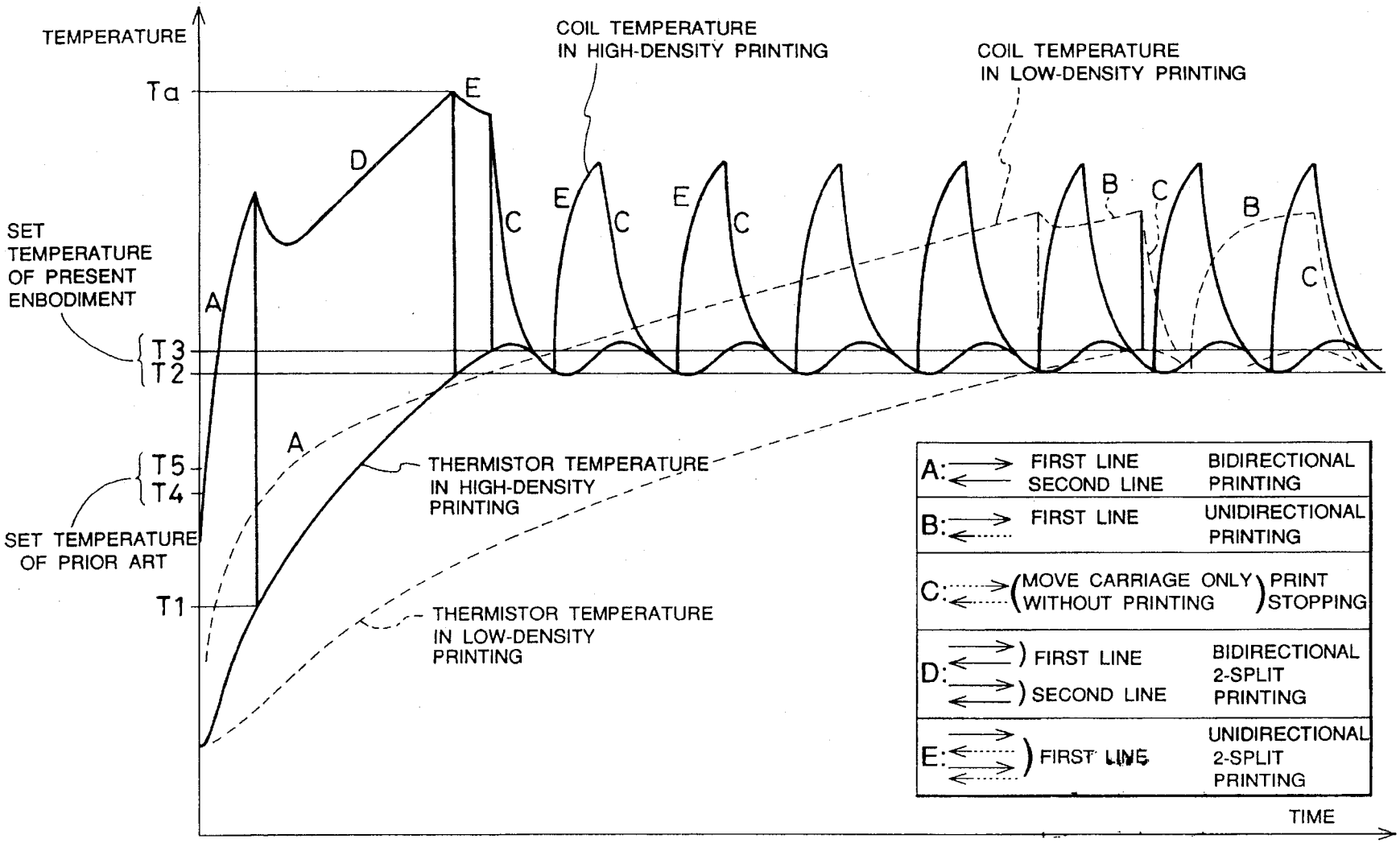
FIG. 6 is a graph illustrating the relations between the actual temperatures of a print head coil according to the present invention and the detected temperatures of a temperature detecting element with the lapse of time.

FIG. 6 is a graph illustrating the relations between the actual temperatures of a print head coil 7 in the embodiment and the detected temperatures of the thermistor 6 with the lapse of time. In FIG. 6, curves in solid lines plot the actual temperatures of the print head coil 7 in the one-line print control of the high density and the measured temperatures detected by the thermistor 6, and curves in broken lines plot the actual temperatures of the print head coil 7 in the one-line print control of the low density and the measured temperatures detected by the thermistor 6. Moreover, at a set temperature T1, the high-density printing operation is switched from a bidirectional mode to a bidirectional two-split mode. At a set temperature T2, the printing operation is switched from a bidirectional mode to a unidirectional mode. The mode is switched in the high-density printing operation from the bidirectional two-split to unidirectional two-split ones and in the low-density printing operation from the bidirectional to unidirectional ones. At a set temperature T3, the printing operation is switched to stop. At a set temperature T4, the printing operation is switched in an example of the prior art from the bidirectional to unidirectional modes. At a set temperature T5, the printing operation is switched to stop in the example of the prior art.

In FIG. 6, moreover, letter A indicates the bidirectional printing operation, e.g., the printing operation in which the print head 8 prints one line while it moves from the left to the right and another line while it moves from the right to the left after it changes the line. Letter B indicates the unidirectional printing operation, e.g., the printing operation in which the print head 8 prints one line only while it moves from the left to the right but not while it moves from the right to the left. Letter C indicates the print stop, i.e., the operation in which only the carriage is moved without any printing. Letter D indicates the bidirectional two-split printing operation, e.g., the printing operation in which the print head 8 prints the portion corresponding to the upper half of the one-line print data while it moves from the left to the right and the portion corresponding to the lower half of the one-line print data while it moves from the right to the left without changing the line and then repeats again the same printing operation of the next line after it changes the line. Letter E indicates the unidirectional two-split printing operation, e.g., the printing operation in which the print head 8 prints the portion corresponding to the upper half of the one-line print data while it moves from the left to the right but does not print any while it moves from the right to the left without changing the line and in which it prints the portion corresponding to the lower half of the one-line print data while it moves again from the left to the right but does not print any while it moves from the right to the left after changing the line.

In the above description, the two-split printing operation is termed such that the portion corresponding to the upper half of the print data and then the portion corresponding to the lower half of the print data. In the two-split printing operation, according to the present embodiment, the print head 8 has its armatures set to even and odd pins and the even pins and the odd pins are subjected to the two divided printing operations by alternately driving the even pins and the odd pins based on the print data.

Here will be described the case in which it is determined at Step b3 by the CPU 1 that the one-line printing to be executed at this time is of high density. The CPU 1 determines at Step b4 whether or not the print stop flag fa is set to the value "1" specifying the print stop. Specifically, it is determined whether or not the print head coil 7 is brought at present into the print stop by the rise of the coil temperature as a result of continuation of the printing operation. The description will be made assuming that the coil temperature of the print head coil 7 is low immediately after the start of the one-line printing operation. Since the print stop flag fa is at the initial value "0" in this time, the CPU 1 proceeds to Step b5, at which it is determined whether or not the temperature of the print head coil 7 stored in the detected temperature storage register r1 reaches the set temperature T1.

Immediately after the start of the one-line printing processing, the printing operation itself is not started so that the coil temperature of the print head 8 does not reach the set temperature T1 either. Thus, the determination result of Step b5 is false so that the CPU 1 proceeds to Step b8, at which it executes the bidirectional printing to print the first one-line print data which are latched in the print buffer by the operation of Step a5 of Task 1.

After the operation of Step b8, the CPU 1 proceeds to Step b11, at which the value of the one-line print flag f2 is initialized to "0", and the value of the index register i is incremented by one at Step b12. Thus, the processing of Task 2 of this period is ended.

As the value of the index register i is updated by one, the CPU 1 in the processing of Task 1 of the subsequent period prepares the one-line print data of the next line in the operation of Step a5 after the operations of Steps a1, a3 and a4. Subsequently, the operations of Steps a6 to a10 are executed. If the density is discriminated to be high at Step a7, the individual operations of Steps b1 to b5 are executed in the processing of Task 2 after end of the processing of Task 1. After this, the operation of Step b8 is executed again to execute the one-line printing of the next line. Then, the processing of Task 2 of this period is ended by executing the operations of Steps b11 and b12.

In case all the one-line print data prepared in the processing of Task 1 are of high density, the coil temperature of the print head coil 7 gradually raises, when the bidirectional printing is continuously executed. Accordingly, the detected temperature of the thermistor 6 rises. When the detected temperature data of the thermistor 6 stored in the detected temperature storage register r1 reach the set temperature T1, the determination result of Step b5 is true. Then, the CPU 1 proceeds to Step b6, at which it is determined whether or not the value of the detected temperature storage register r1 is smaller than the set temperature T2.

In this case, the determination result of Step b6 is false, because the detected temperature data of the thermistor 6 stored in the detected temperature storage register r1 are short of the set temperature T2 when they reach the set temperature T1 at first after the one-line printing operation has been started. Then, the CPU 1 proceeds to Step b9, at which it executes the bidirectional two-split printing operation to print the one-line print data latched in the print buffer.

After this Step b9, the CPU 1 ends the processing of Task 2 of this period by executing the operations of Steps b11 and b12.

In the processing of Task 2 on and after the subsequent period, the CPU 1 repeats the one-line bidirectional two-split printing operations by executing repeatedly the operations of Steps b1 to b6, the bidirectional two-split printing operation of Step 9, and the operations of Steps b11 and b12 for each predetermined processing period.

In the bidirectional two-split printing operation, the print data of the print head coil 7 in the print head 8 are excited separately two times in the low density so that the heat produced in the coil 7 is less than that is produced in the bidirectional printing operation in which the print head coil 7 is wholly excited based on all the one-line print data. Thus, as shown in FIG. 6, the print head 8 is cooled to release its heat by the moving action of the carriage for a while after the print mode is switched from the bidirectional to bidirectional two-split ones, so that the actual coil temperature of the print head 8 drops. After this, however, heat is still generated in the bidirectional two-split printing operation so that temperature of the print head 8 is changed to a gentle rise by repeating the bidirectional two-split printing operation.

On the other hand, the value of temperature data detected by the thermistor 6 raises continuously due to a delay in response because the thermal conduction between the thermistor 6 and the print head 8 is poor.

When the detected temperature data of the thermistor 6 stored in the detected temperature storage register r1 reach the set temperature T2, the CPU 1 determines the determination result of Step b6 to be true, and proceeds to Step b7, at which it is determined whether or not the value of the detected temperature storage register r1 is smaller than the set temperature T3.

In this case, after the start of the one-line printing operation, the detected temperature data of the thermistor 6 stored in the detected temperature storage register r1 do not reach the set temperature T3 yet when they reach the set temperature T3 at first. Thus, the determination result of Step b7 is true, and the CPU 1 proceeds to Step b10, at which it executes the unidirectional two-split printing operation to print the one-line print data latched in the print buffer.

After the operation of Step b10, the CPU 1 ends the processing of Task 2 of this period by executing the operations of Steps b11 and b12.

In the processing of Task 2 on and after the subsequent period, the CPU 1 executes repeatedly the individual operations of Steps b1 to b7, the unidirectional two-split printing operation of Step b10 and the operations of Steps b11 and b12 for each predetermined processing period, and repeats the one-line printing operation in the unidirectional two-split mode.

When the printing mode is switched from the bidirectional two-split printing mode to the unidirectional two-split print mode, the coil temperature of the print head 8 drops while the carriage moves backward because the print head 8 is not excited but cooled. On the contrary, the value of the detected temperature data of the thermistor 6 raises continuously due to a delay in the response because the thermal conduction between the thermistor 6 and the print head 8 is poor.

When the detected temperature data of the thermistor 6 stored in the detected temperature storage register r1 reach the set temperature T3, the CPU 1 determines that the determination result of Step b7 is false, and proceeds to Step b14, at which it executes the print stopping operation. Specifically, the CPU 1 ends the processing of Task 2 of this period by not exciting the print head coil 7 but moving the carriage only and sets (Step b15) the print stop flag fa to the value "138 specifying the print stop.

In the processing of Task 2 on and after the subsequent period, as the print stop flag fa is set to the value "1", the determination result is made true in Step b4 after the operations of Steps b1 to b3, and the CPU 1 proceeds to Step b13. In Step b13 it is determined whether or not the value of the detected temperature data of the thermistor 6 stored in the detected temperature storage register r1 is lower than the set temperature T2.

The detected temperature of the thermistor 6 immediately after execution of the print stopping operation is not lower than the set temperature T2 because the print head 8 is not cooled down yet. Thus, the CPU 1 determines that the result of Step b13 is false, and ends the processing of Task 2 by executing the printing stopping operation of Step b14 and the operation of Step b15.

The CPU 1 executes repeatedly the operations of Steps b1 to b4 and the operations of Steps b13, b14 and b15 for each predetermined processing period. In the meanwhile, the print head 8 is not excited but cooled by the movements of the carriage so that the value of the detected temperature data of the thermistor 6 drops as the print head 8 is cooled.

In the processing of Task 1, on the other hand, the print stop flag fa is set to the value "1", and the CPU 1 ends the processing of Task 1 by determining that the result of Step a4 is true after the operations of Steps a1 and a3. As a result, the operations from Steps a5 to a10 are not executed, so that the one-line print data at the time of executing the print stopping operation are latched in the print buffer without being changed to the next one-line print data.

When the value of the detected temperature data of the thermistor 6 stored in the detected temperature storage register r1 drops to the set temperature T2 or lower, the CPU 1 determines that the result of Step b13 is true, and initializes the processing by setting the value of print stop flag fa to "0" (Step b16). The CPU 1 then proceeds to Step b10 to print one line by executing the unidirectional two-split print operation again and ends the processing of Task 2 by executing the operations of Steps b11 and b12. As a result, the one-line print data at the time of the print stopping operation are printed.

In the processing of Task 1, on the other hand, the value of the print stop flag fa is initialized to the value "0" so that the operations of Steps a5 to a10 are executed to set the one-line print data of the next line in the print buffer.

In the processing of Task 2 on and after this time, heat is generated in the print head coil 7 by starting the unidirectional two-split printing again, to raise the temperature of the print head 8, so that the detected temperature data of the thermistor 6 have their value raised with the temperature rise of the print head 8 until it reaches again the set temperature T3. As a result, the unidirectional two-split printing operation is switched to the print stopping operation by the CPU 1 so that the print head 8 is cooled. Thus, in the high-density print operation, the unidirectional two-split printing operation and the print stopping operation are repeatedly executed when and after the printing mode is switched to the unidirectional two-split mode.

When the index register i has its value updated at each end of the one-line printing operation so that the final one line is printed, it takes the present value (n+1). In the processing of Task 1 to be subsequently executed, the CPU 1 determines after the operation of Step a1 that the result of Step a3 is true, and ends the processing of Task 1 by initializing the print data input flag F0 to the initial value "0" (at Step a14).

Since the print data input flag F0 is set to the value "0", the print data inputting operation is executed if a printing is demanded from the host side.

Here will be described the case in which it is determined at Step b3 that the one-line printing operation to be executed by the CPU 1 is of low density.

The CPU 1 determines at first (at Step b17) whether or not the print stop flag fa is set to the value "1" specifying the print stopping state, that is, whether or not the print head 8 is brought at present into the print stopping state by the rise of the coil temperature of the print head coil 7 due to the continuation of the printing operation. Despite of this fact, however, the following description will be made assuming that the coil temperature of the print head 8 is low immediately after the start of the one-line printing operation. Since the print stop flag fa is set to the initial value "0" in this case, the CPU 1 proceeds to Step b18, at which it is determined whether or not the value indicating the temperature of the print head 8 and stored in the detected temperature storage register r1 is lower than the set temperature T2.

Since the printing operation is not started immediately after the start of the one-line printing operation, the coil temperature of the print head 8 does not reach the set temperature T2 yet. Thus, the CPU 1 proceeds to Step b19, at which it executes the bidirectional printing operation to print the first one-line print data which are latched in the print buffer at Step a5 of Task 1.

After the operation of Step b19, the CPU 1 proceeds to Step b20 to set the one-line print flag f2 to the initial value "0" and ends the processing of Task 2 of this period by incrementing the value of the index register i by one (Step b21).

When the value of the index register i is updated by one, the CPU 1 executes Steps a1, a3 and a4 in Task 1 of the subsequent period to prepare the next one-line print data (Step a5) and then executes the operations of Steps a6 to a10. If the density is determined to be low, the CPU 1 executes, in the processing of Task 2 after the end of Task 1, the operations of Steps b1 to b3 and the operations of Steps b17 to b18. After this, the CPU 1 executes the operation of Step b19 again to print the next one line and ends the processing of Task 2 of this period by executing the operations of Steps b20 and b21.

In case all of the one-line print data prepared by the processing of Task 1 are of low density, the coil temperature of the print head 8 raises gradually when the bidirectional printing is continuously executed. However, since the print data are of low density, the excitation frequency of the print head coil 7 of the print head 8 is smaller than that at the time of high-density printing operation. Therefore, the temperature rise due to the heat generation of the print head 8 is gentle. As a result, the rise of the detected temperature of the thermistor 6 accompanying the coil temperature rise of the print head 8 at the low-density printing time can follow the temperature rise of the print head 8.

When the detected temperature data of the thermistor 6 stored in the detected temperature storage register r1 reach the set temperature T2 (Step b18), the CPU 1 determines that the result of Step b18 is false, and proceeds to Step b22, at which it is determined whether or not the value of the detected temperature storage register r1 is smaller than the set temperature T3.

In this case, the detected temperature data of the thermistor 6 stored in the detected temperature storage register r1 do not reach the set temperature T3 yet when they reach the set temperature T2 at first after the start of the one-line printing operation. Thus, the CPU 1 determines that the result of Step b22 is false, and proceeds to Step b23, at which it executes the unidirectional printing operation to print the one-line print data latched in the print buffer.

After the operation of Step b23, the CPU 1 ends the processing of Task 2 of this period by executing the operations of Steps b20 and b21.

In the processing of Task 2 on and after the subsequent period, the CPU 1 executes repeatedly the operations of Steps b1 to b3 and Steps b17, b18 and b22, the unidirectional printing operation of Step b21 and the operations of Steps b20 and b21 for each predetermined period, to repeat the one-line print operation in the unidirectional printing mode till the value of the detected temperature storage register r1 reaches the set temperature T3.

Immediately after the printing mode is switched from the bidirectional to unidirectional modes, the movement of the carriage and the excitation time of the print head 8 are halved so that the coil temperature of the print head 8 slightly drops. After this, however, heat is also generated in the unidirectional direction, so that the coil temperature of the print head 8 is gently raised by repeating the unidirectional printing operation.

On the other hand, the value of the detected temperature data detected by the thermistor 6 continues to rise gently due to a delay in the response because the thermal conduction between the thermistor 6 and the print head 8 is poor.

When the detected temperature data of the thermistor 6 stored in the detected temperature storage register r1 reach the set temperature T3, the CPU 1 determines that the result of Step b22 is false, and proceeds to Step b24, at which it executes the print stopping operation, i.e., moves the carriage only without exciting the print head coil 7. The CPU 1 then ends the processing of Task 2 of this period by setting the print stop flag fa to the value "1" specifying the print stop (Step b25).

In the processing of Task 2 on and after the subsequent period, the CPU 1 determines, after it has executed the operations of Steps b1 to b3, that the result of Step b17 is true, because the print stop flag fa is at the value "1", and proceeds to Step b26, at which it is determined whether or not the value of the detected temperature data of the thermistor 6 stored in the detected temperature storage register r1 is lower than the set temperature T2.

Since the detected temperature of the thermistor 6 immediately after the print stopping operation is not below the set temperature T2 because the print head 8 is not cooled yet, the CPU 1 determines that the result of Step b26 is false, and ends the processing of Task 2 by executing the print stopping operation of Step b24 and the operation of Step b25.

Until the value of the detected temperature storage register r1 drops below the set temperature T2, the CPU 1 executes repeatedly for each predetermined period the operations of Steps b1 to b3 and the individual operations of Steps b17, b26, b24 and b25. In the meanwhile, moreover, the print head 8 is not excited but cooled by the movement of the carriage, so that the value of the detected temperature data of the thermistor 6 drops accordingly as the print head 8 is cooled. On the other hand, since the print stop flag fa is set to the value "1" in the processing of Task 1, the CPU 1 ends the processing of Task after the operations of Steps a1 and a3 by determining that the result of Step a4 is true. As a result, the operations of Steps a5 to a10 are not executed, but the one-line print data at the time of executing the print stopping operation are latched in the print buffer without being changed to the next one-line print data.

When the value of the detected temperature data of the thermistor 6 stored in the detected temperature storage register r1 is dropped to the set temperature T2 or lower as a result of cooling the print head 8, the CPU 1 determines that the result of Step b26 is true. Then, the CPU 1 sets the value of the print stop flag fa to the initial value "0" (Step b27), executes the unidirectional printing operation again to print one line (Step b28) and then it ends the processing of Task 2 by executing the operations of Steps b20 and b21. As a result, the one-line print data when the print stopping operation is executed are printed.

In the processing of Task 1, moreover, the print stop flag fa is set to the initial value 0 so that the one-line print data of the next line are set in the print buffer.

In the processing of Task 2 after this time, the unidirectional printing operation is started again so that the print head 8 generates the heat. When the detected temperature of the thermistor 6 reaches the set temperature T3, the CPU 1 executes the print stopping operation to cool the print head 8. Thus, in the low-density printing operation, the unidirectional printing operation and the print stopping operation are repeated on and after the printing mode is switched to the unidirectional one.

As the index register i has its value updated at each end of the one-line printing operation, when the final line is printed, it has the present value (n+1). In the processing of Task 1 to be subsequently executed, the CPU 1 determines, after the operation of Step a1, that the result of Step a3 is true, and ends the processing of Task 1 by setting the print data input flag F0 to the initial value "0" (at Step a14).

Figure 7:
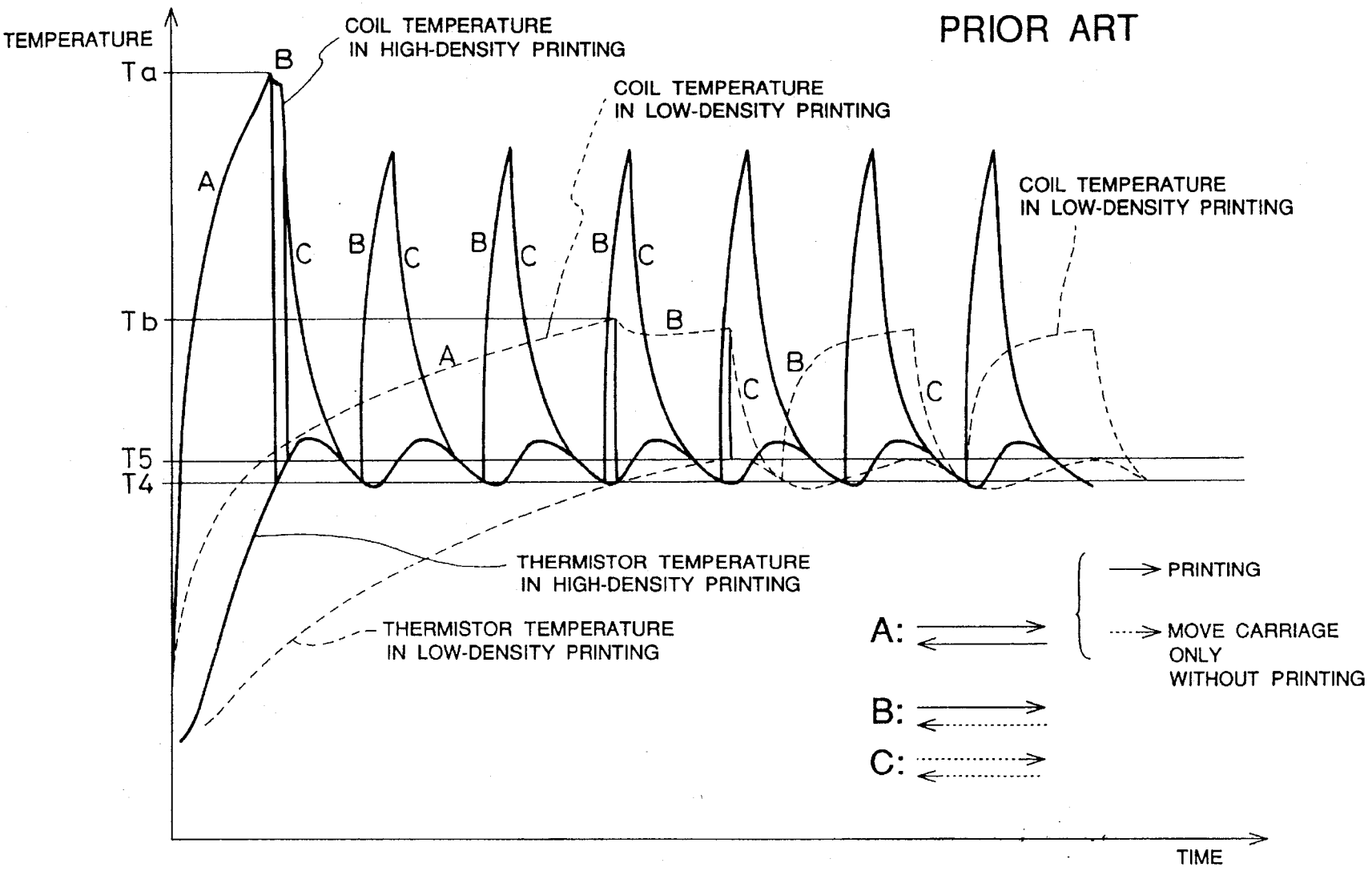
FIG. 7 PRIOR ART
FIG. 7 is a graph illustrating the relations between the actual temperatures of the print head coil of a serial dot printer device of the prior art and the detected temperatures of a temperature detecting element with the lapse of time.

FIG. 7 is a graph illustrating the relations between the actual temperatures of the print head coil of an example of the prior art and the detected temperatures of the thermistor with the lapse of time. In FIG. 7, curves in solid lines plot the actual temperatures of the print head coil in the one-line print control of the high density and the measured temperatures detected by the thermistor, and curves in broken lines plot the actual temperatures of the print head coil in the one-line print control of the low density and the measured temperatures detected by the thermistor. At a set temperature T4, the printing operation is switched in an example of the prior art from the bidirectional to unidirectional modes. At a set temperature T5, the printing operation is switched to stop in the example of the prior art.

Moreover, the letters A, B and C appearing in FIG. 7 similar to those of FIG. 6 in the embodiment of the present invention.

The controls of the one-line printing in the high-density printing operation according to the present invention will be compared with the example of the prior art. In this example, in case the bidirectional printing is started to raise the temperature of the print head, the difference between the coil temperature of the print head and the detected temperature of the thermistor gradually increases with the rise in the coil temperature of the print head because the temperature rise of the print head is steep. This shortens the time period for the detected temperature of the thermistor to reach the set temperature T4 at which the bidirectional printing mode is switched to the unidirectional printing mode. In the embodiment of the present invention, on the contrary, in case the bidirectional printing is started to raise the temperature of the print head, the bidirectional printing mode is switched to the bidirectional two-split printing mode to reduce the excitation rate of the print head coil 7 per unit time when the temperature of the thermistor 6 reaches the predetermined temperature T1. As a result, an abrupt rise of the coil temperature of the print head can be suppressed to reduce the difference between the coil temperature of the print head and the detected temperature of the thermistor 6. This shortens the time period from the start of the printing operation for the detected temperature of the thermistor to reach the set temperature T4 at which the printing mode is switched to the unidirectional two-split printing mode.

In the present embodiment, moreover, the set temperature T1, at which the bidirectional printing mode is switched to the bidirectional two-split printing mode, is lower than the set temperature T4 at which the bidirectional printing mode is switched in the example of the prior art to the unidirectional printing mode. In case the print data are of high density in the example of the prior art, the heat generation of the print head is abrupt. Even if the bidirectional printing mode is switched to the unidirectional printing mode when the coil temperature of the print head reaches the set temperature T4, the coil temperature arrives, before the print head is cooled, at the set temperature T5 for the print stopping control so that the printing operation is stopped. In the present embodiment, on the contrary, the set temperature T1 is set to a lower value than that of the set temperature T4 of the example of the prior art. This can make the temperature rise of the print head coil gentle to elongate the time period for the print stopping control to reach the set temperature T3 and accordingly the effective time period for the printing operation.

Here will be made a comparison of the printing control of the one-line printing operation in the low-density printing mode between the embodiment and the example of the prior art. In this example, the low-density print data and the high-density print data are not substantially discriminated, but the temperature for switching the bidirectional print mode to the unidirectional printing mode is set to the common set temperature T4 even for the low-density print data.

In case the printing density per line is dense, the switching temperature is set for a limit coil temperature Ta, below which the coil is not burned. In case the actual printing per line is of low density, the detected temperature of the temperature detecting element may reach the set temperature T4 if the low-density printing operation is repeated, when a temperature Tb sufficiently lower than the coil burning limit temperature Ta. The detected temperature may reach the set temperature T4 even if the temperature rise of the coil is so gentle that the difference between the detected temperature of the temperature detecting element and the actual coil temperature is smaller than that in the high-density printing operation. As a result, the switching control to the unidirectional printing mode is effective to elongate the time period till the end of the printing operation. In the present embodiment, on the contrary, the high-density print data and the low-density print data are so discriminated that the set temperature T1 for switching the bidirectional printing mode to the bidirectional two-split printing mode is provided in case of the high-density print data. As a result, the set temperature T2 for switching the bidirectional printing mode to the unidirectional printing mode when in the low-density printing operation can be set to a higher value than the set temperature T4 in the example of the prior art. As a result, the effective time period for the printing operation can be elongated to shorten the throughput time period, i.e., the time period for printing a predetermined amount of print.

According to the present invention, the excitation frequency of the print head coil is reduced, and the cooling time period of the print head is elongated. As a result, the abrupt temperature rise of the print head can be suppressed to reduce the difference between the temperature of the print head and the detected temperature of the temperature detecting element. Thus, the coil of the print head can be prevented from being burned in the printing operation without being charged with a thermal conducting agent, and can the print head be produced at a reasonable cost.

For the printing operation, moreover, the high-density print data and the low-density print data are discriminated so that the printing control in case of the low-density printing operation can be carried out at a second set value higher than the first set value, at which the printing control for the high-density printing operation is effected. As a result, the second value can be arbitrarily set to a higher value than that of the prior art without being influenced by the first set value for the printing control of the high-density printing operation. As a result, the effective time period for the printing operation can be elongated to shorten the throughput time period, i.e., the time period for printing a predetermined amount of print.

What is claimed is:

1. A serial dot printer device comprising:

a print head bidirectionally movable for printing line by line according to print data;

temperature detecting means disposed in the vicinity of said print head for detecting the temperature of said print head;

print data density discriminating means for discriminating whether the print data of one line of the print data inputted have high density or low density; and print control means for switching the printing mode of said print head from a bidirectional printing mode to a unidirectional printing mode when said print data density discriminating means detects that the print data of the one line are of low density and that the detected temperature of said print head exceeds a first predetermined value, said print control means also switching the printing mode of said print head from the bidirectional printing mode to a split mode, in which one line is printed separately by at least two times, when said print data density discriminating means detects that the print data of the one line are of high density and that the detected temperature of said print head exceeds a second predetermined value lower than said first predetermined value.

2. A serial dot printer device according to claim 1, wherein said print control means switches the printing mode of said print head from the bidirectional printing mode to a bidirectional two-split printing mode, in which a portion corresponding to one half of the one-line print data is printed when said print head moves in one direction and in which a portion corresponding to the remaining half of said one-line print data is subsequently printed when said print head moves in the opposite direction, when it is determined by said print data density discriminating means that the print data of the one line are of high density and that the detected value of said temperature detecting means exceeds a predetermined value.

3. A serial dot printer device according to claim 2, wherein said print control means switches the printing mode from the bidirectional print mode to the bidirectional two-split printing mode, in which the portion corresponding to the upper half of the one-line print data is printed when said print head moves in one direction and in which a portion corresponding to the lower half of said one-line print data is subsequently printed when said print head moves in the opposite direction.

4. A serial dot printer device comprising:

a print head bidirectionally movable for printing line by line according to print data;

temperature detecting means disposed in the vicinity of said print head for detecting the temperature of said print head;

print data density discriminating means for discriminating whether the print data of one line of the print data inputted have high density or low density;

comparing means for comparing the detected value of said temperature detecting means with a predetermined value; and print control means for switching the printing operation of said print head on the basis of the discrimination result of said print data density discriminating means and the comparison result of said comparing means, wherein said comparing means compares the detected temperature with a first set value, when it is determined by said print data density discriminating means that the print data of one line are of low density, and said detected temperature with a second set value when it is determined by said print data density discriminating means that the print data of one line are of high density, and wherein said first set value is higher than said second set value.

* * * * *